US012385169B2

(12) United States Patent
Priami et al.

(10) Patent No.: US 12,385,169 B2
(45) Date of Patent: Aug. 12, 2025

(54) TEXTILE ARTICLE FOR MOTORCYCLIST PROTECTIVE CLOTHING

(71) Applicant: MANIFATTURA PRI.MA.TEX S.R.L., Prato (IT)

(72) Inventors: Christian Priami, Scarperia e San Pietro (IT); Simone Shiocchetto, Capraia e Limite (IT)

(73) Assignee: MANIFATTURA PRI.MA TEX S.R.L., Prato (IT)

( * ) Notice: Subject to any disclaimer, the term of this patent is extended or adjusted under 35 U.S.C. 154(b) by 834 days.

(21) Appl. No.: 17/056,377

(22) PCT Filed: May 17, 2019

(86) PCT No.: PCT/IB2019/054092

§ 371 (c)(1),
(2) Date: Nov. 17, 2020

(87) PCT Pub. No.: WO2019/220404

PCT Pub. Date: Nov. 21, 2019

(65) Prior Publication Data

US 2021/0207296 A1 Jul. 8, 2021

(30) Foreign Application Priority Data

May 18, 2018 (WO) ..... PCT/IB2018/053519

(51) Int. Cl.
*D03D 1/00* (2006.01)
*A41D 31/24* (2019.01)
(Continued)

(52) U.S. Cl.
CPC ..... *D03D 1/0041* (2013.01); *A41D 31/245* (2019.02); *D03D 13/004* (2013.01);
(Continued)

(58) Field of Classification Search
CPC .. D03D 1/0041; D03D 13/004; D03D 13/008; D03D 15/283; D03D 15/47;
(Continued)

(56) References Cited

U.S. PATENT DOCUMENTS

2004/0048538 A1 3/2004 Granqvist et al.
2010/0075557 A1 3/2010 Shteiyer

FOREIGN PATENT DOCUMENTS

BR 1120200234125 7/2024
CN 112135539 B 1/2023
(Continued)

OTHER PUBLICATIONS

International Search Report and Written Opinion in corresponding International Patent Application No. PCT/IB2018/053519 dated Feb. 12, 2019. 8 pages.
(Continued)

*Primary Examiner* — Elizabeth M Imani
(74) *Attorney, Agent, or Firm* — Leason Ellis LLP

(57) ABSTRACT

A protective fabric is described, preferably for motorcyclist professional clothing, said monolayer or coupled fabric comprising at least two coupled fabrics which surprisingly meets all the requirements of the applicable reference standards for abrasion, cut and burst resistance, while maintaining unchanged exceptional characteristics of softness, breathability, comfort, washability.

21 Claims, 3 Drawing Sheets

Protective fabric weft profile of example 1 (Prior Art)

(51) Int. Cl.

| | |
|---|---|
| ***D03D 13/00*** | (2006.01) |
| ***D03D 15/283*** | (2021.01) |
| ***D03D 15/47*** | (2021.01) |
| ***D03D 15/56*** | (2021.01) |

(52) U.S. Cl.
CPC ..... *D03D 13/008* (2013.01); *D03D 15/283* (2021.01); *D03D 15/47* (2021.01); *D03D 15/56* (2021.01); *A41D 2600/102* (2013.01); *D10B 2321/0211* (2013.01); *D10B 2321/042* (2013.01); *D10B 2331/021* (2013.01); *D10B 2331/04* (2013.01); *D10B 2501/04* (2013.01)

(58) Field of Classification Search
CPC ..... D03D 15/56; D03D 11/00; D03D 15/58; A41D 31/245; A41D 2600/102; D10B 2321/0211; D10B 2321/042; D10B 2331/021; D10B 2331/04; D10B 2501/04; D10B 2331/02
See application file for complete search history.

(56) References Cited

FOREIGN PATENT DOCUMENTS

| | | | | |
|---|---|---|---|---|
| EP | 0962562 | A1 | 12/1999 | |
| EP | 3796802 | B1 | 7/2024 | |
| GB | 2478855 | A | 9/2011 | |
| ID | P000085242 | | 1/2023 | |
| IT | 10201500051902 | A1 | 3/2017 | |
| MX | 408477 | | 4/2021 | |
| MY | PI2020006034 | | 10/2023 | |
| RU | 2796289 | C2 | 5/2023 | |
| WO | WO-2019166574 | A1 * | 9/2019 | ..... D03D 1/0041 |

OTHER PUBLICATIONS

International Search Report and Written Opinion in corresponding International Patent Application No. PCT/IB2019/054092 dated Sep. 16, 2019. 9 pages.
Notice of Acceptance for Australian Application No. 2019238590 dated Jun. 6, 2024; 1 page.
Office Action in corresponding Australian Application No. 2019238590 dated Feb. 29, 2024; 2 pages.
English translation of Office Action in corresponding Brazilian Application No. BR112020023412-5 dated May 16, 2023, one page.
English translation of Office Action in corresponding Chinese Application No. 201980033456.9, 1 page.
Decision to grant in corresponding European Application No. 19730549.3 dated Jun. 27, 2024; 2 pages.
English translation of Office Action in corresponding Mexican Application No. MX/a/2020/012363, dated Aug. 21, 2023; 3 pages.
English translation of Office Action in corresponding Malaysian Application No. PI 2020006034 dated Aug. 21, 2023; 9 pages.
English translation of Office Action in corresponding Russian Application No. 2020141686 dated Mar. 14, 2023; 2 pages.
English translation of Office Action in corresponding Indonesian Application No. IDP000085242, 1 page.

* cited by examiner

Protective fabric weft profile of example 1 (Prior Art)

Protective fabric weft profile of example 2

Protective fabric weft profile of example 3

Fabric warp profile of example 4

Lower fabric warp profile

TEXTILE ARTICLE FOR MOTORCYCLIST PROTECTIVE CLOTHING

FIELD OF THE INVENTION

The present invention relates to the field of textile articles for clothing, in particular it refers to a textile article for motorcyclist protective clothing.

BACKGROUND

As is known in the accident prevention field, the antiperforation, anti-cut, high abrasion resistant and anti-burst fabrics that are normally used in the safety footwear and safety clothing field (for example antiperforation insoles, bulletproof vests, suits for motorcycle clothing, etc.) are of particular importance, suitable to protect the user in case of accidents.

The EN 13595-1:2002 standard is the main standard in Europe that regulates protective clothing for professional motorcyclists. The norm provides for a division of the garments into 4 zones, wherein zones 1 and 2 correspond to the most exposed and most at risk parts (elbows, arms, shoulders, knees, hips), zones 3 and 4 correspond to parts less at risk, in addition there are 2 safety levels, wherein level 1 covers the minimum requirements and level 2 the highest requirements for more performing materials, so-called "racing".

TABLE 1

Requirements according to standard EN 13595-1: 2002

| EN 13595-1: 2002 (Protective Clothing For Professional Motorcyclists) | Zone | Level 1 requirements | Level 2 requirements |
|---|---|---|---|
| 5.4 (Resistance to impact abrasion after 5 washes) (s) | 1&2 | ≥4.0 s | ≥7.0 s |
| | 3 | ≥1.8 s | ≥2.5 s |
| | 4 | ≥1.0 s | ≥1.5 s |
| 5.5 (Resistance to impact cut after 5 washes) | 1&2 | ≤25 mm | ≤15 mm |
| | 3 | ≤30 mm | ≤25 mm |
| | 4 | ≤35 mm | ≤30 mm |
| 5.6 (Resistance to impact burst after 5 washes) | 1&2 | ≥700 Kpa | ≥800 Kpa |
| | 3 | ≥500 Kpa | ≥600 Kpa |
| | 4 | ≥400 Kpa | ≥450 Kpa |

Currently, protective clothing for professional (and not) motorcyclists are made of leather. The Bovine Leather (used for professional and non-professional motorcycling clothing, in fact the bovine leather has a lower quality compared to the kangaroo which is compulsorily used for the suits of professional riders) normally it has a weight of 1000-1400 g/m$^2$, a thickness of 1.2-1.6 mm and demonstrates an abrasion resistance according to EN 13595 Standard >4 seconds (level 1). The Kangaroo Leather (used for professional motorcycling suits) normally presents a weight of 800-1000 gr/m$^2$, a thickness of 0.8-1.2 mm and demonstrates an abrasion resistance according to EN 13595 Standard >4 seconds (level 1). It is noted that in all the circuits for speed races it is NOT allowed by the internal regulations clothing DIFFERENT from the leather. The leather, however, has the following disadvantages: non-breathable, not washable, not thermally insulating (during the fall riders burned from the heat that develops), flammable, non-water repellent, not very comfortable compared to a fabric, not Eco-friendly.

TABLE 2

Test results according to EN 13595-1: 2002 for bovine and kangaroo skin

| EN 13595-1: 2002 (Protective Clothing For Professional Motorcyclists) | Zone | Bovine/ kangaroo skin |
|---|---|---|
| 5.4 (Resistance to impact abrasion after 5 washes) (s) | 1&2 | 4/6 |
| | 3 | 1, 8/2, 2 |
| | 4 | 1, 8/2, 2 |
| 5.5 (Resistance to impact cut after 5 washes) (mm) | 1&2 | 16.5-22 |
| | 3 | 20-28 |
| | 4 | 20-28 |
| 5.6 (Resistance to impact burst after 5 washes) (Kpa) | 1&2 | 500/1000 |
| | 3 | 500/1000 |
| | 4 | 500/1000 |

The research in this field is always aimed to providing fabrics that, while ensuring the essential protective effect, are as soft, elastic and breathable as possible in order to minimize unwanted effects when worn.

Following the aforementioned perspective, it was attempted to decrease the weight and thickness of the fabrics used more and more often, while maintaining the desired protective effect, an example is the motorcyclist clothing fabric described in the Italian patent application n. 102015000051 902 in the name of the same Applicant, said fabric wherein the yarns constituting the weft have a diameter equal to or different from that of the yarns constituting the warp and wherein the count of said yarns is between 100-700 dtex and possibly colored, coated or resined. In particular, a fabric consisting of a weft wherein the number of overlayered weaving wefts is 10 (corresponding to a weft in which the number of overlayered weaving wefts is 5) and a warp whose number of overlayered weaving wefts is 20 (corresponding to a warp in which the number of overlayered weaving threads is 10) is described, wherein the yarns are in high tenacity polyester elasticized for the weft having a count of 580 dtex(PL HT) and for the warp, in high-tenacity polyester, a count of 240-280 dtex. Such a fabric had a weight equal to about 1000 g/m$^2$ and a thickness of about 1.8 mm. Such fabric has been certified in class 2 according to the current EN ISO 13595-2002 Standard: —PROTECTIVE CLOTHING FOR PROFESSIONAL MOTORCYCLIST; however, despite wearability and comfort were better than leather; the weight and thickness of the fabric compared to leather garments currently widely used by professional motorcyclist constituted a limit.

The aforementioned Standard provides for 2 security levels, Class 1 and Class 2, where for Class 1 the values of abrasion on the CAMBRIDGE ABRASION MACHINE (the instrument required by the Standard to perform the abrasion resistance test) must be greater than 4 seconds, for Class 2 the values must be greater than 7 seconds. This type of test results to be extremely aggressive towards the tested materials, therefore, to achieve the requirements by the Standard it has been necessary to create materials with important weight and thickness such that they result in heavy and not very comfortable clothes. The traffic laws does not impose the obligation, in any Community country, to wear protective clothing that respect such Standard during the non-professional driving of motorbikes and motorcycles. Reason why the future Standard pr EN 17092 will see 3 new levels of security less restrictive, to induce habitual motorcyclists to wear garments that provide minimal protection in the event of an accident.

The aforementioned patent application on behalf of the same applicant has been an important step forward in terms of safety, portability and comfort, but the market, in parallel with the new revision project of the EN ISO 13595 Standard proposed to the European Commission, requires materials that are increasingly lighter and thinner, but at the same time safe and resistant. The new project pr EN 17092 of the Standard proposed to the European Commission, establish that the levels of protection established by the Standard itself become 5, wherein the first 2 levels "A+A+A and A+A" are the most important and the established requirements remained the same as the two classes of protection of the current Standard, which we will call RACING requirements, while other 3 levels of protection for urban motorcycling have been proposed, which we will call URBAN requirements, with lower parameters than Racing, just to try to induce who habitually use the motorcycle, to wear protective clothing.

Our research then turned to a structural and targeted improvement of the products made to date, to make available to the market suitable materials and in line with current and future European directives.

Object of the present invention is therefore to provide a textile article which possesses requirements corresponding to ISO 13595:2002 and subsequent modifications but characterized by weights and thicknesses (a weight of less than 1000 g/m$^2$ and a thickness of less than 1.5 mm) such as to guarantee even softness and comfort for the making of protective clothing or (possibly with a weight less than or equal to 1500 g/m$^2$ and a thickness less than or equal to 2.0 mm) for use as reinforcement materials for the further protection of the most exposed areas.

SUMMARY OF THE INVENTION

Subject of the present invention is a protective fabric according to claim 1.

Subject of the present invention is also a laminated protective fabric according to claim 6.

In fact, it has been surprisingly found that the protective fabric according to the invention is an advanced, light, thin, extremely comfortable, soft and incredibly resistant textile article able to resist to abrasion, cutting and bursting, able to, in fact, satisfying widely all the parameters imposed by the future EN ISO 13595 Standard for the RACING class, further increasing the already exceptional properties of resistance, elasticity, softness and flexibility on the final product, that make it an innovative and extremely safe material for the production of professional motorcyclist clothing with all the advantages of breathability and comfort that only a fabric can give.

As compared to the fabric described in Italian patent application n. 102015000051902 on behalf of the same Applicant, the laminated or unlaminated protective fabric of the present invention has weight and thickness reduced of 20-25%, this being particularly striking in the case of the laminated fabric being a 2-layer laminated fabric. Moreover, the mechanical-physical resistances of the finished product were found increased in a considerable manner, so for example, in one embodiment as laminated fabric it has demonstrated an abrasion resistance according to EN 13595 Standard >16 seconds.

The laminated or unlaminated protective fabric of the present invention also shows several other advantages because it can be colored in all the desired colors by using the normal staining methods, whether in fiber, in the piece or by printing.

The laminated or unlaminated protective fabric according to the invention is machine-washable, breathable, eco-friendly because completely recyclable, if desired it can be elasticized.

If desired, the laminated or unlaminated fabric of the invention can be subjected to coating or resin treatment with the known products and used for this purpose, for example to make antacid, waterproof, fireproof a fabric, etc. The aforesaid characteristics allow a great ease of use and a fabric according to the invention can therefore be easily used to manufacture protective clothing (PPE—Personal protective equipment), especially for motorcycling, (such as suits, trousers, jackets, vests, coats, etc.) or to manufacture sportswear which also requires a considerable ability to protect the user using the normal cutting, sewing and making procedures that are used in the sector. It can also be used as a reinforcement material in exposed areas and most at risk.

Subject of the present invention is also a method for the preparation of a laminated fabric according to the invention, said method comprising the lamination of the upper layer to the lower layer by means of known traditional coupling techniques or by quilting (seam of the 2 layers).

DETAILED DESCRIPTION OF THE INVENTION

Protective Fabric According to the Invention

Figure 1:
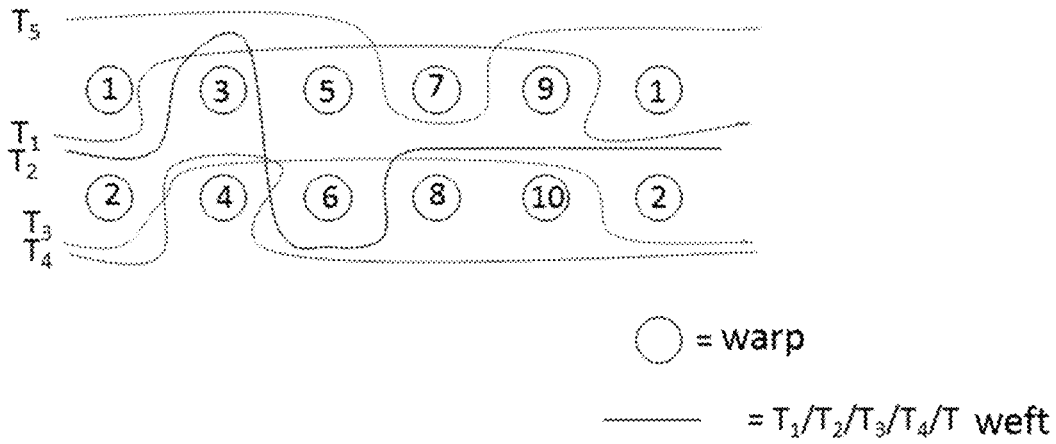
FIG. 1—shows the weft profile of an embodiment (comparative example 1) of a fabric according to the state of the art.

The protective fabric according to the invention consists of a weft in which the number of overlayered wefts is 2-4, even more preferably 2 or 4 and a warp in which the number of overlayered warpsis 10-50, preferably 10-16, even more preferably 10.

Any type of woven multilayer weave can be used for the construction of the upper fabric according to the invention (for example, double, double-double-sided, triple, quadruple, six-fold, eight-fold, etc.) and furthermore also the binding is of the known type which is normally used in this field, for example a binding in lowered, in raised or a combination of the two or by inversion of the warps or of the wefts may be used. The weft yarns are inserted into the warp according to traditional techniques using the looms usually used for the weaving of this type of articles.

The yarns constituting the warp preferably have a count of 200-300 dtex, more preferably 220-280 dtex. The yarns constituting the warp are preferably composed of 40-100 filaments, preferably 40-60 or 60-80 filaments. The yarns constituting the warp are preferably twisted and optionally elasticized. Preferably according to the present invention the yarns constituting the warp of the protective fabric according to the invention are polyester or polyamide filaments (for example nylon), preferably high tenacity, and optionally elasticized with elastomers of known type. The yarns constituting the warp are preferably twisted and optionally elasticized polyester (PL) HT or polyamide (PA) HT yarns. Even more preferably, the yarns constituting the warp have a dtex of 230-275 dtex or 230-270 dtex and a composition by weight of 85-95% of PA and 0-15% or 5-15% of elastomer (EA).

Preferably the yarns constituting the weft of the protective fabric according to the invention are chosen from the group consisting of:

- polyester or polyamide filaments, possibly being high tenacity,
- high molecular weight polyethylene (UHMWPE) yarns such as dyneema® or derivatives,
- liquid crystal polymers (LCP) fiber yarns such as Vectran® or Vectran® derivatives,
- para-aramid (AR) fiber yarns such as Kevlar® or derivatives,
- polytetrafluoroethylene (PTFE) fiber yarns such as Teflon® or derivatives, or
- a mixture of the aforementioned yarns;

said parallel or twisted and optionally elasticized yarns with elastomers of a known type.

The yarns constituting the weft preferably have a count of 530-630 dtex, more preferably 550-610 dtex. The yarns constituting the weft are preferably composed of 50-150 filaments, preferably 90-110 filaments. The yarns constituting the weft are preferably twisted and elasticized polyester (PL) HT yarns. Even more preferably, the yarns constituting the weft have a dtex of 560-600 dtex and a weight composition of 90-98% PL and 2-10% elastomer (EA).

The fabric according to the invention preferably has 20-200 yarns per cm in weft, more preferably 45-85, even more preferably 80, and 20-200 yarns per cm in warp, more preferably 45-85, even more preferably 65.

Figure 2:
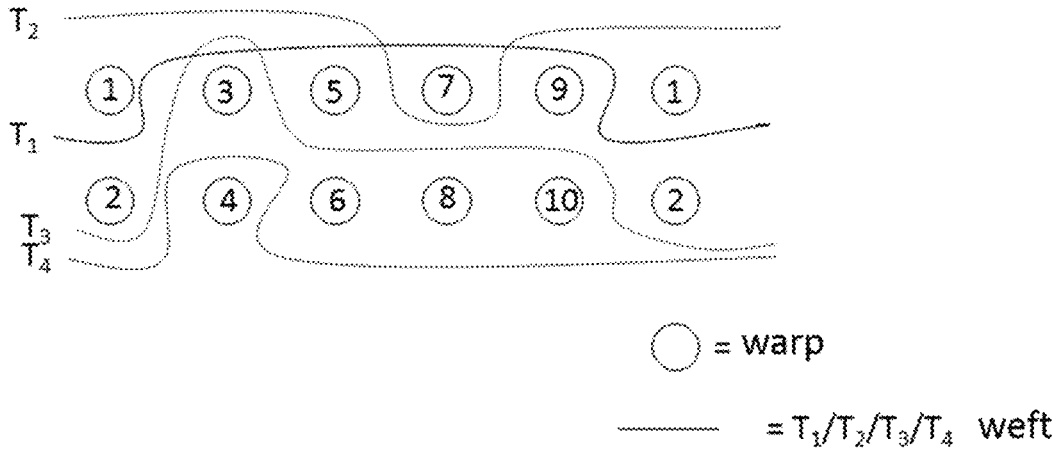
FIG. 2—shows the weft profile of an embodiment (example 2) of a fabric according to the invention.

With the particularly preferred specifications described above, it has been possible to prepare a fabric having a weight of about 400-900 g/m$^2$, preferably 600-800 g/m$^2$ and a thickness of about 0.7-1.5 mm, preferably 1-1.4 mm, which it turned out to be extremely comfortable, light and workable, in FIG. 2 the weft profile of a preferred embodiment of the protective fabric according to the invention is shown.

Laminated Fabric

The laminated protective fabric according to the present invention preferably comprises of only two layers; an upper fabric and a lower fabric.

Preferably, the upper layer is different from the lower layer.

The yarns constituting the weft of the upper fabric have a different diameter and composition from those of the yarns constituting the warp;

Preferably, the yarns constituting the lower fabric weft have the same diameter and composition to that of the yarns constituting the warp.

Upper Fabric

The upper fabric is constituted by a weft wherein the number of overlayered wefts is 2-20, more preferably 2-6, still more preferably 2, 4 or 5 and a warp wherein the number of overlayered yarnsis 10-50, preferably 10-16, even more preferably 10. Any type of woven multilayer weave can be used for the construction of the upper fabric according to the invention (for example, double, double-double-sided, triple, quadruple, six-fold, eight-fold, etc.) and moreover also the binding is of the known type which is normally used in this sector, for example you can use a binding in lowered, in raised or a combination of the two or by inversion of the warps or of the wefts.

The weft yarns are inserted into the warp according to traditional techniques using the looms usually used for weaving of this type of articles.

The yarns constituting the warp have a count of 200-300 dtex, more preferably 220-280 dtex. The yarns that constitute the warp are preferably composed of 40-100 filaments, preferably 40-60 or 60-80 filaments. The yarns constituting the warp are preferably twisted and optionally elasticized. Preferably, according to the present invention, the yarns constituting the warp of the upper fabric are polyester or polyamide filaments (for example nylon), preferably at high-tenacity, and optionally elasticized with known type elastomers. The yarns constituting the warp are preferably twisted and optionally elasticized polyester (PL) HT or polyamide (PA) HT yarns. Even more preferably, the yarns forming the warp have a dtex of 230-275 dtex o 230-270 dtex and a composition by weight of 85-95% of PA and 0-15% o 5-15% of elastomer (EA).

Preferably, the yarns constituting the weft of the upper fabric are selected in the group consisting of:

- filaments of polyester or polyamide, possibly being high tenacity,
- high molecular weight polyethylene yarns (UHMWPE) such as dyneema® or derivatives,
- liquid crystal polymer fiber (LCP) yarns as for example vectran® or vectran® derivatives,
- para-aramid fiber (AR) yarns, as for example kevlar® or derivatives,
- polytetrafluoroethylene fiber yarns (PTFE) as for example Teflon® or derivatives, or
- a mixture of the aforementioned yarns;

said parallel or twisted yarns and optionally elasticized yarns with known type elastomers.

The yarns constituting the weft have a count of 530-630 dtex, more preferably 550-610 dtex. The yarns constituting the weft are preferably composed of 50-150 filaments, preferably 90-110 filaments. The yarns constituting the weft are preferably twisted and elasticized polyester (PL) HT yarns. Even more preferably, the yarns constituting the weft have a dtex of 560-600 dtex and a composition by weight 90-98% of PL and 2-10% of elastomer (EA).

The upper fabric according to the invention preferably has 20-200 yarns per cm in weft, more preferably 45-85, even more preferably 65, and 20-200 yarns per cm in the warp more preferably 45-85, even more preferably 65.

Figure 4:
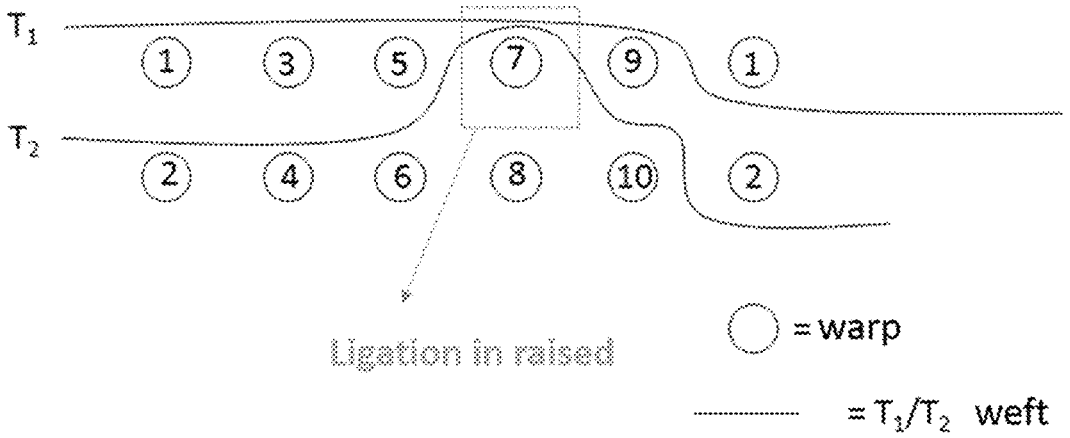
FIG. 4 shows the weft profile of an embodiment (example 4) of a fabric according to the invention.

With the particularly preferred specifications described above, it was possible to prepare a upper fabric having a weight of about 400-800 gr/m$^2$, preferably 600 gr/m$^2$ and a thickness of about 0.7-1.3 mm, preferably 1.0 mm, which turned out to be extremely comfortable, light and workable, in FIG. 4 is shown the weft profile of a preferred embodiment of the upper fabric layer.

Lower Fabric

Preferably, according to the present invention, the yarns constituting the warp and the weft of the lower fabric are preferably the same and selected in the group consisting of

- polyester or polyamide yarns, preferably being high-tenacity,
- high molecular weight polyethylene yarns (UHMWPE), such as dyneema® or derivatives,
- liquid crystal polymer fiber (LCP) yarns such as vectran® or derivatives,
- para-aramid fiber (AR) yarns such as kevlar® or derivatives,
- polytetrafluoroethylene (PTFE) fiber yarns such as Teflon® or derivatives, or
- a mixture of the aforementioned yarns, said parallel or twisted yarns and preferably elasticized with known type elastomers.

Preferably, the lower fabric consists of a simple canvas wherein the yarns forming the warp are the same as the yarns constituting the weft and alternate with drawing 1A-1B and wherein both A and B are selected from the listed fibers above. Clearly, various alternations are possible with the design of yarns A and B, the preferred one is 1A-1 B, but other possible ones are 2A-2B, 3A-3B, 1A-2B, 2A-1 B, etc.

More preferably, the yarn in A is polyester HT and the yarn in B is polyamide/UHMWPE in mixture, both yarns in A and B are elasticized.

Preferably, the composition by weight of the yarn A is 90-98% of PL and 2-10% of elastomer (EA). Preferably, the composition by weight of the yarn B is 40-50% of UHMWPE, 45-55% of PA and 5-10% of elastomer (EA).

The weft yarns are inserted into the warp according to traditional techniques using the looms usually used for the weaving of this type of articles.

Figure 5:
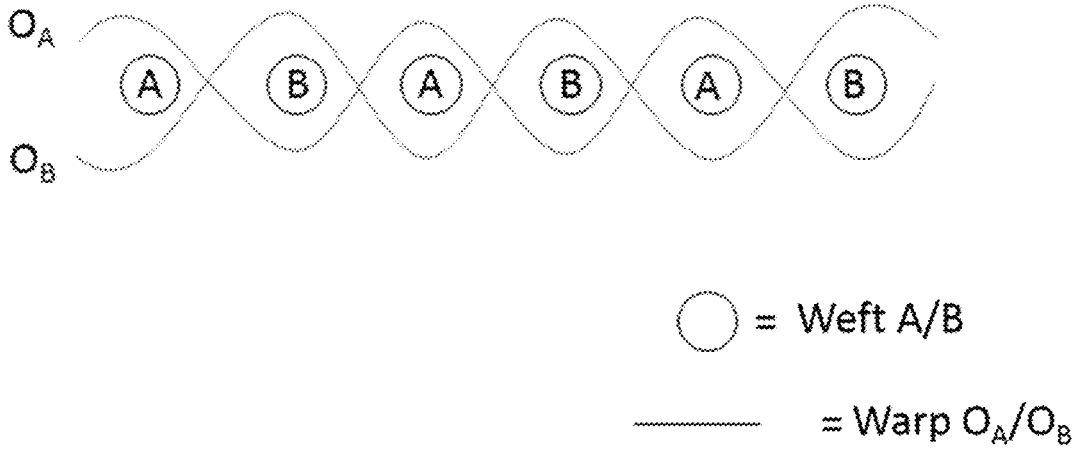
FIG. 5 shows the warp profile of an embodiment (example 4) of a lower fabric according to the invention.

The weaving preferably used is a simple canvas, as illustrated in the warp profile in FIG. 5.

Preferably the yarns count constituting the weft and the warp is 100-700 dtex, more preferably 350-650 dtex, preferably 550-600 dtex for the yarn A and 420-480 dtex for the yarn B; the warp yarns may be parallel but preferably are twisted and elasticized, while those of the weft may be indifferently twisted or parallel and elasticized.

The yarns constituting the weft may have the same diameter as the yarns constituting the warp or different diameter.

The lower fabric according to the invention preferably has 10 to 200 yarns per cm in weft, more preferably 10-30, even more preferably 18-24, most preferably 22; and 10-200 yarns per cm in the warp preferably 10-30, more preferably 18-24, even more preferably 22.

With the particularly preferred specifications described above, it had been possible to prepare a lower fabric having a weight of about 150-500 g/m$^2$, preferably 300 g/m$^2$ and a thickness of about 0.2-0.6 mm, preferably 0.4 mm, which was found to be extremely comfortable, light and workable and surprisingly resistant.

Lamination

In the laminated fabric according to the invention, the two fabrics, upper and lower, are laminated by means traditional bonding techniques known by the application between the two fabrics of an adhesive means or by quilting, seam between them, of the 2 layers. Among the known bonding techniques, polyurethane (PU) or reactive polyurethane (PUR) lamination, powder coupling, PU film or PL lamination, web lamination, latex lamination are preferred.

The aforesaid adhesive means (also called glue) can be applied by blade, by points or by hot transfer, preferably according to the present invention the selected lamination is reactive polyurethane (PUR) by points, as it allows to maintain exceptional properties of breathability, elasticity, softness without minimally altering the gluing power between the layers, with tightness and resistance to all environmental aging (high temperatures, low temperatures, acid sweat, alkaline sweat, water, etc.) to which the material is subjected.

Preferably, both the upper fabric and the lower fabric, before proceeding to the final phase of PUR by point lamination, preferably in quantities of 30-50 g/m$^2$, take advantage of a good preparation to eliminate all the stiffening agents present on the fibers applied in spinning, warping and weaving steps and possible impurities present in the fibers or collected during the previous workings.

Preferably then, to eliminate all impurities present in the fabric and favor the re-entry and closing of the fibers, which may also be about 25% in both directions if there is the preferred presence of an elastomer both in the weft and in the warp, both the upper and lower fabrics are purged in width, procedure carried out with water and addition of possible detergent soaps, at a temperature of about 90° C. After washing, the fabric must be dried and thermofixed, preferably with a passage carrying out drying in *ramosa* at a temperature of 165° C., speed of 25 m/min, then always in *ramosa* thermofixing at a temperature of 180° C., speed of 25 m/min. The thermofixing serves to give permanent stability for all subsequent procedure (laminaton, dyeing, printing, finishing, industrial washing or domestic washing, etc.). After the thermofixing we proceed with the equalization, a rolling operation with application of steam, to homogenize the surface and to recover softness to the fabric, hardened and strain hardened by the thermofixing.

If the upper fabric and/or the lower fabric contain UHMWPE yarns (for example Dyneema®), the drying and thermofixing phase must be carried out in tumbler, the industrial equivalent of the domestic dryer, which works at temperatures below 100° C., but which performs an important mechanical action given by the centrifugation basket, which determines the maximum re-entry of the fibers, to obtain the same results in terms of dimensional stability of the *ramosa*. For fabrics in which dyneema® fiber (UHMWPE) is present tumbler drying is required because above 110° C. said fiber starts to soften and then melts, completely losing the characteristics that make it one of the most resistant fibers to abrasion, cut and tear on the market. This operation in tumbler is more expensive and time-consuming compared to the thermofixing in *ramosa*, reason why, if not forced by technical reasons, it is preferably avoided.

Once the 2 fabrics have been prepared as described above, we can proceed with the reactive polyurethane (PUR) lamination by points.

This procedure is preferably carried out on cold, on a machine where the thermoplastic PUR is dissolved from the pressure plate heated to about 115° C. (accessory external to the machine) and pushed through a pump to the micro-perforated cylinder for application on the fabrics. Immediately after the application of the glue, the 2 laminated fabrics are crushed by a calender which applies a pressure of about 2.5 tons and immediately rolled up to form a large roll, which remains stationary to cross-link in a heated environment where the temperature must never fall below 15° C. (limit temperature which crystallizes the PUR rendering it ineffective). The cross-linking time depends on the external temperature, at 20° C. 24 h of cross-linking are enough (the minimum time below which it can not be lowered), below 20° C. the cross-linking time proportionally extends it with the decrease the temperature itself.

The advantage of this type of lamination is that once the cross-linking is completed, the PUR does not go back any more, neither with high nor with low temperatures, and gives a permanent seal to all the expected environmental aging and to all the domestic and industrial washings.

The present invention can be better understood in the light of the following embodiment examples.

Embodiment Examples

Example 1 (Comparative)—Protective Fabric

A fabric has been reproduced as described in the Italian patent application n. 102015000051902.

Warp Yarn

Polyester (PL) HT 275 dtex 48 filaments 400 Z twists

Weft Yarn

96 Polyester (PL) HT filaments 550 dtex arranged in a spiral pattern (330 twists per meter, TPM) around a 78 dtex elastomer (EA)

94% Polyester (PL) HT 550 dtex+6% elastomer (EA) 78 dtex

Final count 580 dtex

The fabric has been realized on looms usually used for the weaving of this type of articles, applying a woven multilayer weave (double double-face) of 10 overlayered weaving warps in the warp and 5 overlayered weaving wefts in the weft as shown in FIG. 1.

The resulting fabric has a warp reduction of 70 yarns/cm±5% and a weft reduction of 96 yarns/cm±5%, a weight of 1000 g/m$^2$ and a thickness of 1.80 mm and has shown an abrasion resistance according to EN 13595>8 seconds (level 2).

The fabric is elasticized, machine washable, breathable, completely recyclable, can be dyed and printed in any color, you can make it waterproof, windproof, fireproof etc.

Example 2—Protective Fabric

Warp Yarn

Polyester (PL) HT 275 dtex 48 filaments 400 Z twists

Weft Yarn

96 Polyester filaments (PL) HT 550 dtex arranged in a spiral pattern (330 twists per meter, TPM) around a 78 dtex elastomer (EA)

94% Polyester (PL) HT 550 dtex+6% 78 dtex elastomer (EA)

Final count 580 dtex

The upper fabric has beed made on looms usually used for the weaving of this type of articles, applying a multiple weave (double double-sided) of 10 overlayered weaving warps in the warp and 4 overlayered weaving wefts in the weft as shown in FIG. 2.

The resulting fabric has a warp reduction of 70 yarns/cm±5% and a weft reduction of 80 yarns/cm±5%, a weight of 800 g/m$^2$ and a thickness of 1.40 mm and has shown a abrasion resistance according to EN 13595>5 seconds (level 1).

The fabric is elasticized, machine washable, breathable, completely recyclable, can be dyed and printed in any color, you can make it waterproof, windproof, fireproof etc.

Example 3—Protective Fabric

Warp Yarn

Polyester (PL) HT 275 dtex 48 filaments 400 Z twists

Weft Yarn

96 Polyester (PL) HT filaments 550 dtex arranged in a spiral pattern (330 twists per meter, TPM) around a 78 dtex elastomer (EA)

94% Polyester (PL) HT 550 dtex+6% 78 dtex elastomer (EA)

Final count 580 dtex

Figure 3:
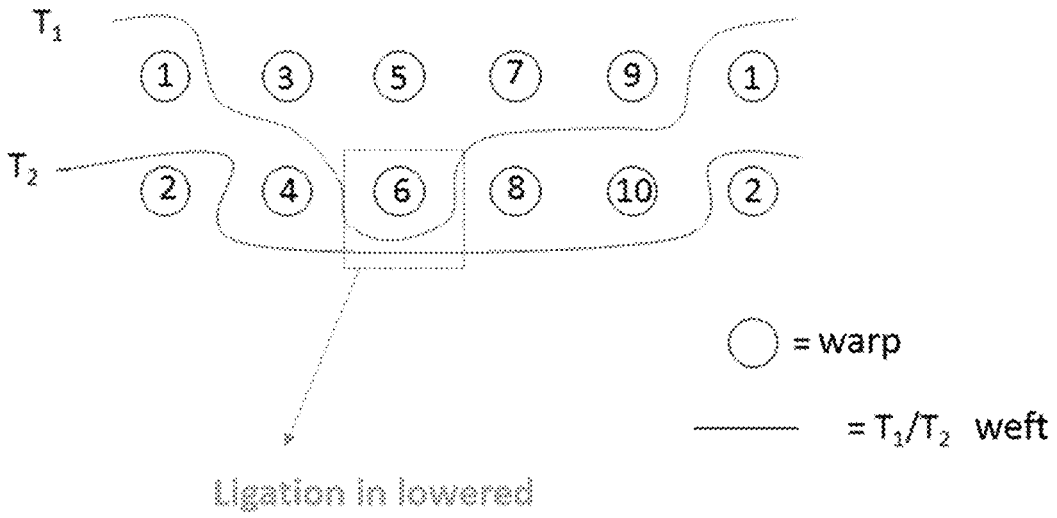
FIG. 3—shows the weft profile of an embodiment (example 3) of a fabric according to the invention.

The fabric has been realized on looms usually used for weaving this type of article, applying a multiple (double) weave of 10 overlayered weaving warps in the warp and 2 overlayered weaving wefts in the weft as shown in FIG. 3 with binding in lowered.

The resulting fabric has a warp reduction of 70 yarns/cm±5% and a weft reduction of 62 yarns/cm±5%, a weight of 600 g/m$^2$ and a thickness of 1.1 mm and shown an abrasion resistance according to EN 13595>4 seconds (level 1).

The fabric is elasticized, machine washable, breathable, completely recyclable, can be dyed and printed in any color, you can make it waterproof, windproof, fireproof etc.

Example 4—Protective Fabric

Warp Yarn 68 filaments of Polyamide (PA) HT 220 dtex arranged in a spiral around an elastomer (EA) of 78 dtex 91% Polyamide (PA) HT 220 dtex+9% elastomer (EA) 78 dtex Final titer 250 dtex Weft Yarn 96 filaments of Polyester (PL) HT 550 dtex arranged in a spiral (330 twists per meter, TPM) around an elastomer (EA) of 78 dtex 94% Polyester (PL) HT 550 dtex+6% elastomer (EA) 78 dtex Final titer 580 dtex The fabric has been made on looms usually used for the weaving of this type of articles, applying a woven multilayer weave of 2 overlayered weaving wefts in the weft and 10 overlayered weaving warps in the warp as shown in FIG. 4 with binding in raised.

The resulting fabric has a warp reduction of 65 yarns/cm±5% and a weft reduction of 65 yarns/cm±5%, a weight of 600 g/m$^2$ and a thickness of 1.00 mm and demonstrated an abrasion resistance in accordance with EN 13595<4 seconds. The fabric is elasticized, machine washable, breathable, completely recyclable, can be dyed and printed in any color, you can make it waterproof, windproof, fireproof etc.

TABLE 3

Test results according to EN 13595-1: 2002 for the fabrics of the invention according to examples 1-4

| EN 13595-1: 2002 (Protective Clothing For Professional Motorcyclists) | Zone | Ex. 1 (COMP) | Ex. 2 | Ex. 3 | Ex. 4 |
|---|---|---|---|---|---|
| 5.4 (Resistance to impact abrasion after 5 washes) (s) | 1&2 | 8.2 | 5.4 | 4.1 | 3.5 |
| | 3 | 8.2 | 5.4 | 4.1 | 3.5 |
| | 4 | 8.2 | 5.4 | 4.1 | 3.5 |
| 5.5 (Resistance to impact cut after 5 washes) (mm) | 1&2 | 18.2 | 24.8 | 25 | n.d. |
| | 3 | 13.3 | 16.5 | 20 | n.d. |
| | 4 | 13.3 | 16.5 | 20 | n.d. |
| 5.6 (Resistance to impact burst after 5 washes) (Kpa) | 1&2 | >1200 | >1200 | >1200 | n.d. |
| | 3 | >1200 | >1200 | >1200 | n.d. |
| | 4 | >1200 | >1200 | >1200 | n.d. |

Example 5—Laminated Fabric

Upper Fabric

The upper fabric is constituted by a protective fabric according to the invention, in particular laminated protective fabrics have been realized in which the upper fabric is constituted by the fabric according to examples 1 and 4.

Lower Fabric

Yarn A of Warp and Weft 96 filaments of Polyester (PL) HT 550 dtex arranged in a spiral (330 twists per meter, TPM) around an elastomer (EA) of 78 dtex 94% Polyester (PL) HT 550 dtex+6% elastomer (EA) 78 dtex Final titer 580 dtex Yarn B of Warp and Weft 130 filaments of UHMWPE (Dyneema®)/Polyamide (PA) arranged in a spiral around an elastomer (EA) of 78 dtex

44% UHMWPE+48% PA+8% EA

Final count 450 dtex

The lower fabric has been made on looms usually used for weaving this type of articles, applying a simple canvas weave and inserting the yarns A and B to design 1A-1B as shown in FIG. 5.

The resulting lower fabric has a warp reduction of 22 yarns/cm and a weft reduction of 22 yarns/cm, a weight of 300 g/m$^2$ and a thickness of 0.40 mm.

Lamination

The upper fabric is purged in width, operation carried out with water and addition of possible detergent soaps, at a temperature of 90° C., to eliminate all impurities present in the fabric and favor the re-entry and closure of the fibers, that in this case can be very high thanks to the preferred presence of the elastomer both in the weft and in the warp, about 25% in both directions, after washing it is dried with a passageway in *ramosa* at a temperature of 165° C., speed of 25 m/min, then always in *ramosa* it is thermofixed at a temperature of 180° C., a speed of 25 m/min, to give permanent stability for all subsequent procedures (lamination, dyeing, printing, finishing, industrial washing or domestic washing, etc.); after thermofixing, proceed with the equalization, a roll-up operation with application of steam, to homogenize the surface and allow the fabric to recover softness, hardened and strain hardened by the thermofixing.

The lower fabric is purged in width exactly as described above for the upper fabric, but the drying and thermofixing phase is carried out in tumbler, the industrial equivalent of the domestic dryer, which works at temperatures below 100° C., but with a important mechanical action given by the centrifuge basket, which determines the maximum re-entry of the fibers, to obtain the same results in terms of dimensional stability of the *ramosa*. This fabric requires tumbler drying when the dyneema® fiber (UHMWPE) is present inside the fabric, because above 110° C. it starts to soften and then melts, completely losing the characteristics that make it one of the most resistant fibers to abrasion, cut and tear on the market. This operation is more expensive and time-consuming compared to the thermofixing in *ramosa*, reason why, if not required for technical reasons, it is preferably avoided. Once the 2 fabrics have been prepared as described above, we can proceed with reactive polyurethane (PUR) lamination by points using an amount of PUR equal to 30-50 g/m$^2$.

This operation is carried out on cold, on a machine where the thermoplastic PUR is melted from the pressing plate heated to about 115° C. (accessory external to the machine) and pushed by a pump to the micro-perforated cylinder for application on the fabrics, immediately after the application of the glue, the 2 laminated fabrics are crushed by a calender that applies a pressure of about 2.5 tons and immediately rolled up to form a large roll, which remains stationary to cross-link in a heated environment where the temperature must never fall below 15° C. (limit temperature that crystallizes the PUR making it ineffective), the cross-linking time depends on the external temperature, at 20° C. 24 h of cross-linking is enough (the minimum time below which it cannot be lowered), below the 20° C. the cross-linking time proportionally extends with the decrease of the temperature itself.

The resulting laminated fabric has, in the case of lamination with upper fabric as ex. 4, a weight of less than 1000 g/m$^2$ and a thickness of less than 1.5 mm and has demonstrated an abrasion resistance according to EN 13595 Standard >16 seconds.

TABLE 4

Test results according to EN 13595-1: 2002 laminated fabrics realized with upper fabric as in ex. 1 and 4

| EN 13595-1: 2002 (Protective Clothing For Professional Motorcyclists) | Zone | Laminated ex. 1 | Laminated ex. 4 |
|---|---|---|---|
| 5.4 (Resistance to impact abrasion after 5 washes) (s) | 1&2 | 12 | 16.6 |
| | 3 | 12 | 16.6 |
| | 4 | 12 | 16.6 |
| 5.5 (Resistance to impact cut after 5 washes) (mm) | 1&2 | 12.3 | 19.3 |
| | 3 | 6 | 11.5 |
| | 4 | 6 | 11.5 |
| 5.6 (Resistance to impact burst after 5 washes) (Kpa) | 1&2 | >1200 | >1200 |
| | 3 | >1200 | >1200 |
| | 4 | >1200 | >1200 |

The fabric is elasticized, machine washable, breathable, completely recyclable, can be dyed and printed in any color, you can make it waterproof, windproof, fireproof etc.

The invention claimed is:

1. A protective fabric consisting of:

warp yarns having count 200-300 dtex;

weft yarns having count 530-630 dtex;

and having a woven multilayer weave consisting of 2, 3 or 4 layers, which in weft the number of overlayered wefts is 2-4, and in warp the number of overlayered warps is 10-50;

said weft and warp yarns consisting of from 10-250 twisted or parallel filaments; and where said yarns are optionally elasticized yarns;

the composition of said warp yarns is selected from the group consisting of polyester, polyamide, high tenacity polyester and high tenacity polyamide, the composition of said weft yarns is selected from the group consisting of polyester, polyamide, high tenacity polyester, high tenacity polyamide, high molecular weight polyethylene, liquid crystal polymer fiber, para-aramid fiber, fiber of polytetrafluoroethylene (PTFE), and mixtures thereof;

having a weight of less than 1000 g/m$^2$ and a thickness of less than 1.5 mm; and A which possesses abrasion requirements corresponding to EN ISO 13595:2002 standard.

2. The protective fabric according to claim 1, having a woven multilayer weave selected in the group consisting of double weave, double-double-face weave and quadruple weave, which in the weft the number of overlayered wefts is 2 or 4, and in the warp the number of overlayered warps is 10-16.

3. The protective fabric according to claim 1, in which the warp yarns are made of high tenacity polyester or high tenacity polyamide, optionally elasticized; and the weft yarns are made of high tenacity polyester, optionally elasticized.

4. The protective fabric according to claim 1 having from 20 to 200 yarns/cm in the weft, and from 20-200 yarns/cm in the warp.

5. The protective fabric according to claim 1 having a weight of about 400-900 g/m$^2$ and a thickness of about 0.7-1.5 mm.

6. A laminated protective fabric comprising at least 2 laminated fabrics, wherein an upper fabric consists of:

warp yarns having count 200-300 dtex;

weft yarns having count 530-630 dtex, said yarns consisting of from 10-250 twisted or parallel filaments, said yarns optionally being elasticized yarns;

and having a woven multilayer weave in which the number of overlayered wefts is from 2-20, and in the warp the number of overlayered warps is from 10-50;

wherein the composition of said warp yarns is selected from the group consisting of polyester and polyamide, wherein said warp yarns are optionally high tenacity, the composition of said weft yarns is selected from the group consisting of polyester, polyamide, high tenacity polyester, high tenacity polyamide, high molecular weight polyethylene, liquid crystal polymer fiber, para-aramid fiber, fiber of polytetrafluoroethylene and mixtures thereof;

and a lower fabric wherein, the lower fabric is of the same construction as the upper fabric or the lower fabric is different from the upper fabric, wherein the lower fabric consists of:

weft and warp yarns having count 100-700 dtex and composed of 10-250 twisted or parallel filaments, said yarns optionally being elasticized;

the weft yarns having the same or a different diameter than the warp yarns;

the yarns that constitute the weft of the lower fabric have a composition that is the same as or different than that of the yarns of the warp, and having a woven simple or multilayer weave in which in the weft the number of overlayered wefts is from 1-20 and in the warp the number of overlayered warps is from 1-50; and wherein the composition of said yarns is selected from the group consisting of polyester, polyamide, high tenacity polyester, high tenacity polyamide, ultra high molecular weight polyethylene, liquid crystal polymer fiber, para-aramid fiber, fiber of polytetrafluoroethylene (PTFE), and mixtures thereof;

having a weight less than or equal to 1500 g/m$^2$ and a thickness less than or equal to 2.0 mm; and which possesses abrasion requirements corresponding to EN ISO 13595:2002 standard.

7. The laminated protective fabric according to claim 6, consisting of 2 laminated fabrics wherein the number of overlayered wefts in the upper fabric is 2-4.

8. The laminated protective fabric according to claim 6, consisting of 2 laminated fabrics wherein the lower fabric has a simple plain weave in which the yarns constituting the warp are the same as the yarns constituting the weft.

9. The laminated protective fabric according to claim 8, wherein the yarns forming the warp and the weft in the lower fabric are a yarn A and a yarn B in alternating fashion and in which the count of the yarns constituting the weft and the warp is from 100-700 dtex.

10. The laminated protective fabric according to claim 9, wherein the yarn A is HT polyester having a count of from 500-600 dtex; and the yarn A is polyamide/UHMWPE in a mixture having a count of from 420-480 dtex, and both yarn A and yarn B are elasticized.

11. The laminated protective fabric according to claim 6, wherein the lower fabric has from 10-200 yarns/cm in the weft, and preferably from 10-30; and from 10-200 yarns/cm in the warp, and preferably from 10-30.

12. The protective fabric according to claim 6 having a weight less than or equal to 1000 g/m$^2$ and a thickness less than or equal to 1.5 mm.

13. A method of manufacturing an article of protective clothing for motorcyclists, the method comprising cutting and sewing a protective fabric according to claim 1 into the article of protective clothing.

14. An article of protective clothing for motorcyclists, said clothing comprising a protective fabric according to claim 1.

15. A method of manufacturing an article of protective clothing for motorcyclists, comprising a cutting and sewing a laminated fabric according to claim 6 into the article of protective clothing.

16. An article of protective clothing for motorcyclists, said clothing comprising a laminated protective fabric according to claim 6.

17. The protective fabric according to claim 1, having a woven multilayer weave selected in the group consisting of double weave, double-double-face weave, triple weave and quadruple weave.

18. The protective fabric according to claim 4 having 25-85 yarns/cm in the weft, and 45-85 yarns/cm in the warp.

19. The laminated protective fabric according to claim 6, wherein the upper fabric has a woven multilayer weave in which the number of overlayered wefts is from 2-6, and in the warp the number of overlayered warps is 10-16.

20. The laminated protective fabric according to claim 9, wherein in the lower fabric the count of the yarns constituting the weft and the warp is 350-650 dtex.

21. The laminated protective fabric according to claim 11, wherein the lower fabric has 10-30 yarns/cm in the weft; and 10-30 yarns/cm in the warp.

* * * * *